United States Patent [19]

Wildmoser

[11] Patent Number: 4,482,282

[45] Date of Patent: Nov. 13, 1984

[54] APPARATUS AND METHOD FOR SUPPLYING ARTICLES

[75] Inventor: Martin M. Wildmoser, Staten Island, N.Y.

[73] Assignee: John Mueller, Northvale, N.J. ; a part interest

[21] Appl. No.: 338,608

[22] Filed: Jan. 11, 1982

[51] Int. Cl.[3] ..... B65B 69/00

[52] U.S. Cl. ..... 414/404; 53/381 A; 414/131; 414/414; 414/417; 414/786

[58] Field of Search ..... 414/125, 130, 403, 404, 414/417, 414, 421, 405, 131, 786; 53/381 A

[56] References Cited

U.S. PATENT DOCUMENTS

| | | | |
|---|---|---|---|
| 1,879,393 | 9/1932 | Miller | 414/404 |
| 2,164,222 | 6/1939 | Rietfort | 414/405 |
| 2,596,339 | 5/1952 | Lufkin | 414/403 X |
| 2,618,421 | 11/1952 | Basus | 53/151 |
| 2,664,216 | 12/1953 | Johnson et al. | 414/403 X |
| 2,682,983 | 7/1954 | Ashcroft | 53/151 |
| 2,876,325 | 3/1959 | Baffrey | 219/10.69 |
| 2,950,829 | 8/1960 | McBean et al. | 414/412 |
| 2,977,006 | 3/1961 | Curry | 414/403 |
| 3,022,913 | 2/1962 | Vincent et al. | 414/417 |
| 3,072,273 | 1/1963 | Foster, Sr. et al. | 414/417 |
| 3,075,652 | 1/1963 | McCoy | 414/330 |
| 3,174,637 | 3/1965 | Flynn | 414/417 |
| 3,550,799 | 12/1970 | Marradi | 414/421 X |
| 3,598,268 | 8/1971 | Wallace | 414/414 X |
| 3,603,462 | 9/1971 | Moser | 414/115 |
| 3,861,543 | 1/1975 | Elsworth | 414/403 |
| 3,863,788 | 2/1975 | Meyer | 414/405 |
| 3,993,203 | 11/1976 | Bartley | 414/405 |
| 4,036,350 | 7/1977 | Jones | 414/41 X |
| 4,049,130 | 9/1977 | Bell | 414/115 |
| 4,095,707 | 6/1978 | Kowtko | 414/405 |
| 4,131,208 | 12/1978 | Voilleumier | 414/131 |
| 4,165,809 | 8/1979 | Klein et al. | 414/104 |
| 4,231,697 | 11/1980 | Franz | 414/37 |
| 4,324,523 | 4/1982 | Zablocky | 414/131 |

FOREIGN PATENT DOCUMENTS

| | | | |
|---|---|---|---|
| 0110571 | 8/1979 | Japan | 414/405 |

*Primary Examiner*—Joseph E. Valenza
*Assistant Examiner*—Ken Muncy
*Attorney, Agent, or Firm*—Lerner, David, Littenberg, Krumholz & Mentlik

[57] ABSTRACT

An apparatus and method for transferring plural articles from a shipping carton to a receptacle from which such articles are orderly removed to a machine for further processing is described. The apparatus is constructed from a shuttle box adapted to receive the shipping carton, a pusher bar adapted to load the shipping carton into the shuttle box and for withdrawing the carton such that the articles remain within the shuttle box, and an ejector blade adapted to reciprocally remove articles from the shuttle box to be conveyed to machine for further processing.

24 Claims, 16 Drawing Figures

APPARATUS AND METHOD FOR SUPPLYING ARTICLES

BACKGROUND OF THE INVENTION

The present invention relates in general to an apparatus and method for supplying articles from an array within a carton and, more particularly, to such apparatus and method for transferring plural articles from a shipping carton to a receptacle from which such plural articles are orderly removed therefrom, e.g., in groups, row-by-row.

In the container filling industry, there frequently arises the problem of transferring fragile cylindrical containers such as bottles, jars, ampules, collapsable tubes or the like from a shipping carton of generally cardboard construction, where they are often arranged in an orderly array, to a machine for further processing. By "machine for further processing" is meant, for example, packaging machines, automatic sealing machines, automatic filling machines, control instruments used to test for the presence of foreign bodies in the container or the like. The reliability of such machines, including the economics of their operation, is to a large extent determined by the method employed for delivering the containers satisfactorily to them from their shipping cartons at a rate compatible with the operating rate of such machines. If the containers are broken, deformed or otherwise damaged while being supplied to such machines, the machine often gets jammed or damaged resulting in very laborious and time-consuming machine repair along with its associated repair costs. In addition, the inability to supply containers to these machines at a compatible rate often results in such machines remaining idle and unproductive while additional containers are being removed from their shipping cartons.

The apparatus and method of the present invention is adapted in one aspect for use in association with known filling and sealing machines for collapsable tubes, for example, toothpaste tubes, medicine tubes, paint tubes or the like. Today, most such collapsable tubes are manufactured from either a soft metal or laminated plastic cylindrical tube of uniform diameter as opposed to the more rigid metal tubes of the prior art. In operation of such filling and sealing machines, it is first required that the tubes be removed from their shipping cartons and supplied to such machines at a compatible rate. Such tubes were previously removed from their shipping carton by an apparatus having groups of mechanical fingers which were inserted into the interior of each tube whereby vacuum or other mechanical means would hold the tube to each finger. The tubes were then removed from the shipping carton and moved by the mechanical fingers to an appropriate conveying location or supply hopper for the machine.

The problems associated with such prior art apparatus incorporating groups of mechanical fingers have been multi-fold. Specifically, the inserting of a finger component into the interior of the tube often resulted in contamination of the tube which was not desirable when filling the tube with such things as medicine and the like. Further, such prior art apparatus often required that the shipping cartons have the tubes separated by cardboard inserts which was an additional expense to be borne by the user of such tubes. Still further, the use of such mechanical fingers necessitated that the tubes be manufactured from materials which would provide such tubes with a fairly stiff sidewall to withstand the force exerted by such fingers and of uniform cross-section to allow for the easy insertion of the fingers. Often, the misalignment of any finger with a tube would result in the damaging of the mouth of such tube causing the failure of such tube to be removed from the shipping carton or rendering the mouth unsuitable for the subsequent filling operation.

As noted, such tubes today have been fabricated out of soft metals and other materials such as laminated plastic and the like. This tube construction results in such tubes being of substantial weaker sidewall strength such that the tubes are often found to have a non-uniform cross-section thereby further rendering such tubes unsuitable for use with these mechanical fingers. Thus, it is apparent that the use of such prior art apparatus incorporating mechanical fingers has resulted in great difficulty when attempting to remove these new types of tubes from their shipping carton by the insertion of such fingers therein. In this regard, it has been common that such tubes were manually removed from their shipping carton and placed into the machine resulting in great labor cost.

As a result, one prior art apparatus designed to accomodate the use of such tubes of soft metal or laminated plastic requires the providing of a specially constructed shipping carton for such tubes having a slot on its bottom side. The shipping carton having such a slot is placed into a station of the apparatus where a horizontally moving blade would enter the slot so as to push one row of tubes out the opposite side of the carton into the machine supply hopper or onto a conveyor. However, such prior art apparatus and method has not had commercial acceptance due to the requirement that the shipping cartons for such tubes be specially constructed with such a slot, requiring additional expense which the user of such tubes has often desired not to bear.

Accordingly, it can be appreciated that there is an unsolved need for an apparatus and method for supplying plural articles provided in an array in a shipping carton without injury or damage to such articles, which apparatus and method is specifically adapted for use in association with high speed automatic continuous processing machines.

SUMMARY OF THE INVENTION

It is broadly an object of the present invention to provide an apparatus and method for supplying plural articles from a carton which overcomes or avoids one or more of the foregoing disadvantages resulting from the use of the above-mentioned prior art apparatus and method and, which fulfills the requirements of an apparatus and method for supplying plural articles provided in an array from a shipping carton, i.e., accurately, cheaply, continuously and rapidly, and adapted for use with high speed automatic processing machines. Specifically, it is within the contemplation of one aspect of the present invention to provide an apparatus and method for supplying plural articles constructed of soft metal, plastic or laminated material and arranged within an array in a shipping carton to a high-speed automatic filling and sealing machine.

A further object of the present invention is to provide an apparatus and method which is specifically suitable for supplying collapsable tubes having relatively weak sidewall strength as a result of being constructed from soft metals, laminated plastic or the like to an automatic filling and sealing machine for such tubes.

A still further object of the present invention is to provide an apparatus and method which supplies plural articles from a shipping carton to a machine for further processing at a rate compatible with the operating rate of such machine.

In accordance with one embodiment of the present invention there is provided an apparatus for supplying articles provided in a carton. The apparatus is constructed from means for receiving a carton having a plurality of articles provided therein, means for arranging the receiving means in a first and second orientation, means for placing the carton into the receiving means when the receiving means is arranged in the first orientation, means for withdrawing the carton from the receiving means when the receiving means is arranged in the second orientation wherein the plurality of articles remain within the receiving means, and means for removing the plurality of articles from the receiving means.

In accordance with the above embodiment, there is further included means for translating the receiving means between a first and second location whereat the arranging means is operable to rotate the receiving means between the first and second orientation.

Further in accordance with the above embodiment, the placing means and withdrawing means are provided at a first location, and the removing means is provided at a second location.

In accordance with another embodiment of the present invention, there is provided an apparatus for supplying articles provided in a carton. The apparatus is constructed of means for receiving a carton having a plurality of articles arranged in an array, means for translating the receiving means between a first and second location, means for positioning the receiving means in a substantially vertical and horizontal orientatioin at the first and second locations, means at the first location for placing the carton into the receiving means when the receiving means is arranged thereat in the vertical orientation, means for withdrawing the carton from the receiving means when the receiving means is arranged in a horizontal orientation wherein the plurality of articles remain within the receiving means, and means at the second location for removing the plurality of articles from the receiving means.

In accordance with the last-mentioned embodiment, the receiving means is constructed of a shuttle box having an opening adapted to receive the carton and having a rear wall opposite the opening provided with a slot arranged to reciprocally receive a portion of the removing means.

Further in accordance with the last-mentioned embodiment the removing means is constructed of an ejection blade adapted for reciprocal movement into the slot in the rear wall of the shuttle box for removing a portion of the array of the articles when entering the shuttle box through the slot.

In accordance with still another embodiment of the present invention there is provided a method for supplying articles provided in a carton. The method comprises the steps of providing a receptacle constructed and arranged for receiving a carton having a plurality of articles provided therein, the receptacle is adapted to be arranged in a first and second orientation, placing the carton into the receptacle when the receptacle is arranged in a first orientation, withdrawing the carton from the receptacle when the receptacle is arranged in a second orientation wherein the plurality of articles remain within the receptacle, and removing the plurality of articles from the receptacle.

In accordance with the last-mentioned embodiment, the method further includes the steps of translating the receptacle to a first location for placing the carton therein and translating the receptacle after withdrawing of the carton therefrom to a second location for removing the plurality of articles from the receptacle.

In accordance with yet still another embodiment of the present invention, there is provided a method for supplying articles provided in a carton. Such method comprises the steps of providing a receptacle constructed and arranged for receiving a carton and having a plurality of articles arranged in an array provided therein, positioning the receptacle in a substantially vertical orientation at a first location, placing the carton into the receptacle, positioning the receptacle having the carton therein in a substantially horizontal orientation at the first location, withdrawing the carton from the receptacle wherein the plurality of articles remain within the receptacle, translating the receptacle from the first location to a second location, positioning the receptacle having the plurality of articles retained therein in a substantially vertical orientation, and removing the plurality of articles from the receptacle at the second location.

BRIEF DESCRIPTION OF THE DRAWINGS

The above description, as well as further objects, features and advantages of the present invention, will be more fully understood by reference to the following detailed description of a presently preferred but nonetheless illustrative apparatus and method for supplying articles from a shipping carton in accordance with the present invention when taken in conjunction with the accompanying drawings, wherein.

DETAILED DESCRIPTION

As thus far described, the present invention relates to an apparatus and method for supplying articles from an array within a shipping carton. Specifically, the apparatus and method of the present invention has been described in accordance with one aspect as being adapted for use in association with filling and sealing machines for collapsable tubes, for example, toothpaste tubes, medicine tubes, paint tubes or the like. As such, the apparatus and method of the present invention is suitably adapted for supplying from a shipping carton collapsable tubes having relatively weak sidewall strength, as a result of being constructed from soft metal, plastic or laminated material, to an automatic filling and sealing machine at a rate compatible with the operating rate of such machine. However, it is contemplated that the apparatus and method of the present invention is suitable for supplying a variety of articles of different design from a shipping carton, such articles being other than those specifically noted above. For example, it is contemplated that the apparatus and method of the present invention is suitable for supplying such variety of articles to a like variety of processing machines, including but not limited to, hollow cylinders to material winding machines, solid bodies of rod or rectangular shape of various material construction to fabrication machines, widgets of various types to assembling machines, etc. Thus, it is readily apparent to one having ordinary skill in the art that the apparatus and method of the present invention is broadly applicable for supplying a variety of various articles from a storage carton to a machine for further processing.

Figure 1:
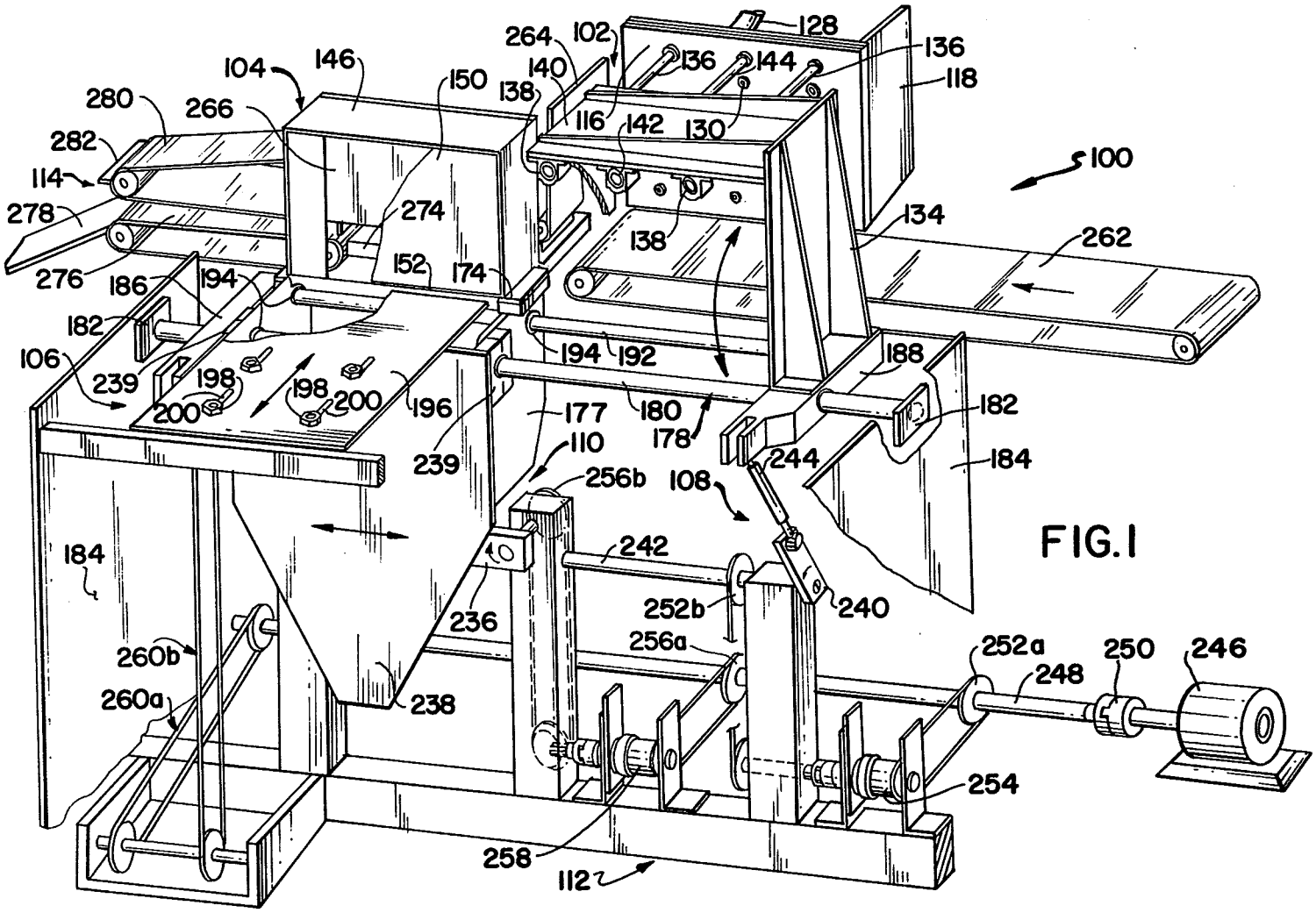
FIG. 1 is a perspective view of the apparatus of the present invention constructed generally of a pusher bar having a carton grasping device located at a first location and a shuttle box arranged in operative association with an ejection blade provided at a second location.

Referring specifically to the drawings, the apparatus and method of the present invention will now be described in greater detail. The overall construction of the apparatus of the present invention will be described with reference to FIG. 1 generally; a further detailed description of the various assemblies of such apparatus will be described further with reference to FIGS. 2 through 8; and, the specific operation of such apparatus in supplying articles from a shipping carton will be described in detail generally with reference to FIGS. 9 through 16. Referring now to the drawings in which like reference characters represent like elements, there is shown in FIG. 1 an apparatus designated generally by reference character 100. The apparatus 100 is generally constructed from a loading assembly 102, a receiving assembly 104, an ejecting assembly 106, a rotating assembly 108, a translating assembly 110, an operating assembly 112 and a conveying assembly 114.

The loading assembly 102 is constructed from a pusher bar 116 of generally rectangular shape having a separating plate 118 secured along one edge thereof extending rearwardly in general transverse relationship. As shown in greater detail in FIG. 5, the pusher bar 116 is constructed from a pair of parallel spaced rectangular plates 120, 122 separated by a circumferential spacer 124 so as to define a sealed vacuum chamber 126. The vacuum chamber 126 is provided in communication with a vacuum source (now shown) via vacuum supply line 128 secured to plate 120. In addition, a plurality of outwardly extending vacuum grippers 130 are randomly secured to plate 120 in communication with the vacuum chamber 126 through an opening 132 provided in each vacuum gripper.

Referring again to FIG. 1, the pusher bar 116 is movably secured to a support member 134 by a pair of rods 136. The rods 136 are attached at one end to the upper portion of the plate 122 of the pusher bar 116 and have their other end slidably engaged in a pair of bearings 138 secured to the under side of the top frame member 140 of the support member 134. Lateral movement of the pusher bar 116 is caused by operation of a hydraulic cylinder 142 secured to the underside of the top frame member 140 and having a moveable piston rod 144 with its free end connected to the upper portion of the plate 122 between the rods 136. Further, the hydraulic cylinder 142 can be replaced by a suitable air cylinder or other linear drive assemblies.

Figure 2:
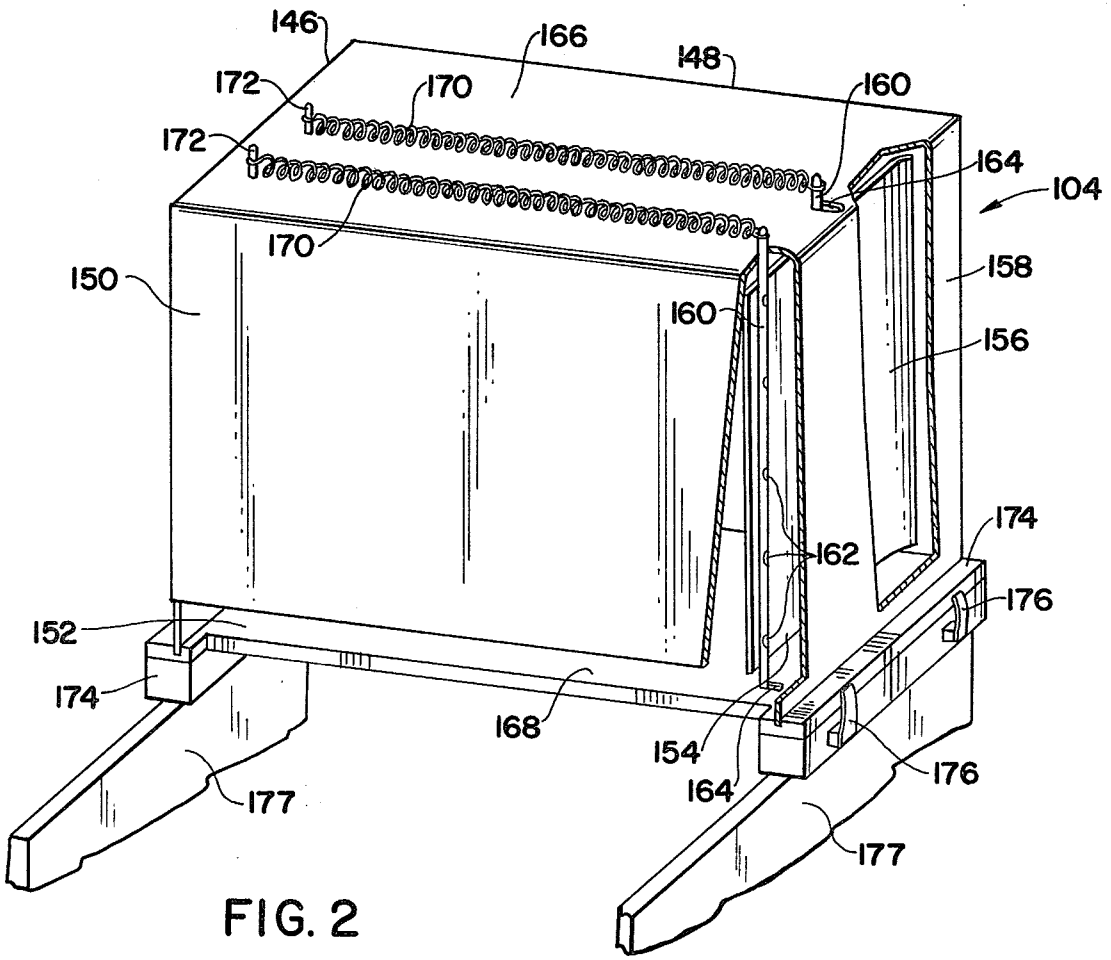
FIG. 2 is a perspective view of the shuttle box having a portion of its sidewalls removed in order to disclose the arrangement of a spring bias retaining wall provided therein.
Figure 5:
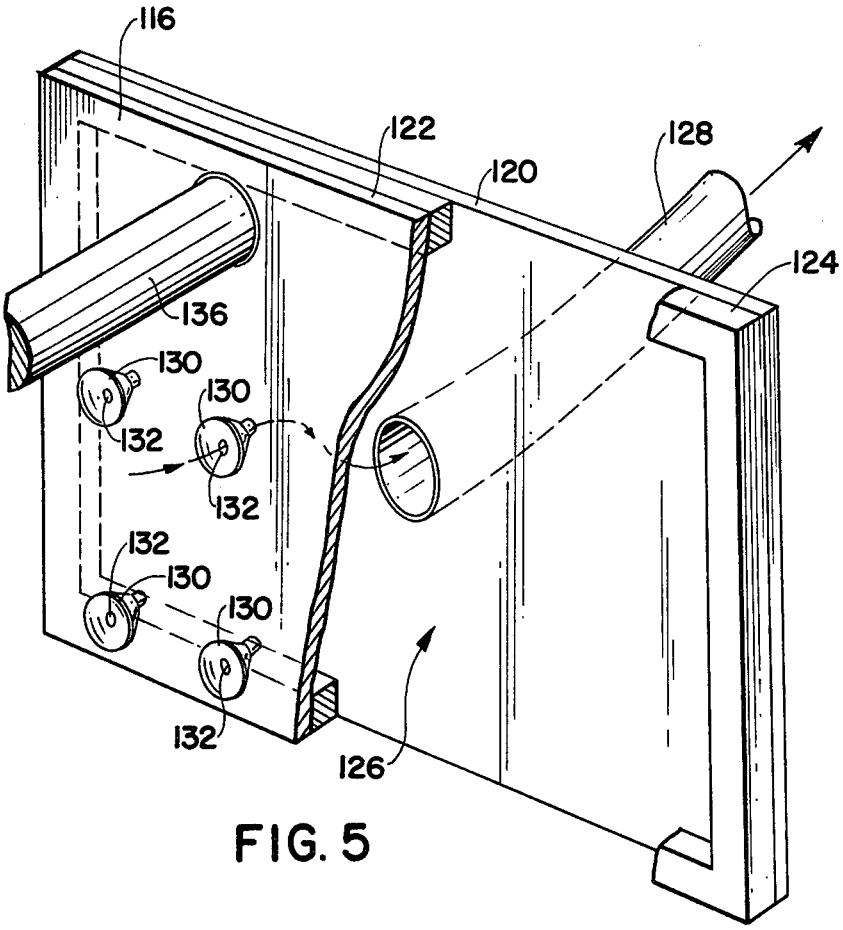
FIG. 5 is a perspective view of the pusher bar and carton grasping device having a portion thereof removed to disclose an internal vacuum chamber thereof.

The receiving assembly 104, as shown in greater detail in FIG. 2, is constructed from a generally rectangular shuttle box 146 having an open side 148 and an opposed rear wall 150 provided with a horizontally arranged slot 152 extending along the bottom edge. A retaining wall 154 having a curved end 156 is provided within the shuttle box 146 adjacent one sidewall 158. The retaining wall 154 is movably secured within the shuttle box 146 by a pair of parallel spaced rods 160 secured to the retaining wall via a plurality of screws 162. The terminal end of each rod 160 extends through a slot 164 provided in the top wall 166 and bottom wall 168 of the shuttle box 146 so as to be engaged by a bias spring 170. The bias springs 170 are arranged in pairs extending over the top wall 166 and have one end secured to the terminal ends of the pair of rods 160 while their other ends are secured to a pair of mounting pins 172. In a like manner, a pair of bias springs 170 (not shown) are arranged along the bottom wall 166 and secured between the terminal ends of the rods 160 and a pair of mounting pins 172 (not shown). The shuttle box 146 includes a pair of mounting brackets 174 provided along its bottom side edges and having a pair of detachable mounting clips 176 for detachably mounting the shuttle box to a pair of spaced apart frame members 177. In addition, as shown in FIG. 3, the shuttle box 146 may be permanently secured to the mounting brackets 174 by bolts.

Figure 3:
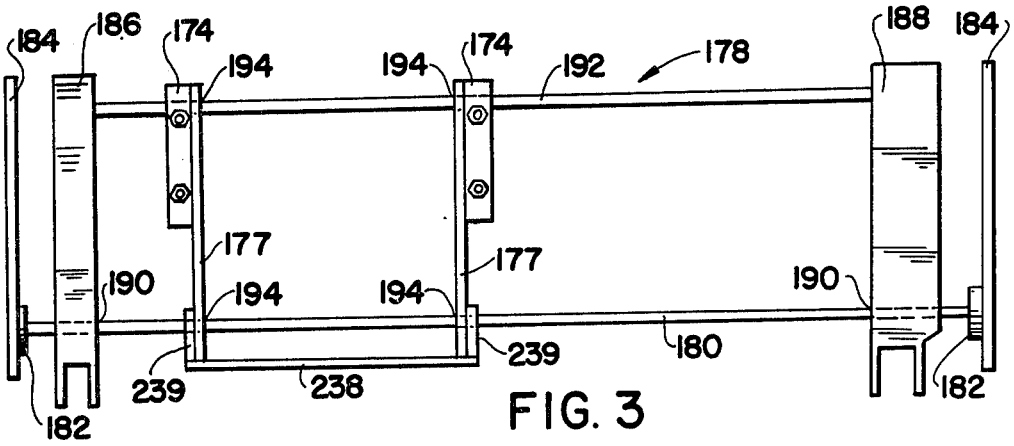
FIG. 3 is a top view of an assembly adapted for translating the shuttle box between the first and second locations.

Referring to FIG. 3, there will now be described an assembly 178 to which the loading assembly 102 and receiving assembly 104 are movably secured for both lateral and rotary movement. The assembly 178, as to be described in operation hereinafter, allows the shuttle box 146 of the receiving assembly 104 to be translated between a first and second location, in addition, to allowing the shuttle box to be rotated between a substantially vertical and horizontal orientation at each of the first and second locations. Similarly, the assembly 178 allows the pusher bar 116 and support member 134 of loading assembly 102 to be rotated between a substantially vertical and horizontal orientation at one of the locations. The assembly 178 is constructed of a longitudinally extending rod 180 supported at its terminal ends within a pair of bearings 182 which are secured to the inside portion of a pair of parallel spaced frame walls 184. A pair of support blocks 186, 188 are positioned within and adjacent to the side frame walls 184 in general parallel arrangement. The common end of the support blocks 186, 188 are provided with an opening 190 adapted to allow the rod 180 to pass therethrough. The opposite common ends of the support blocks 186, 188 are connected by a longitudinally extending rod 192 arranged in parallel relationship with the rod 180. Thus, the support blocks 186, 188 and rod 192 are adapted to be rotated about the rod 180 as to be described hereinafter. The shuttle box 146 is adapted to be translated between the support blocks 186, 188 along rods 180, 192 by such rods passing through a plurality of bearings 194 secured to the frame members 177 upon which the shuttle box is mounted by mounting brackets 174. The pusher bar 116 is operatively secured to the assembly 178 by the support member 134 being secured to the support block 188 as best illustrated in FIG. 1.

Figure 4:
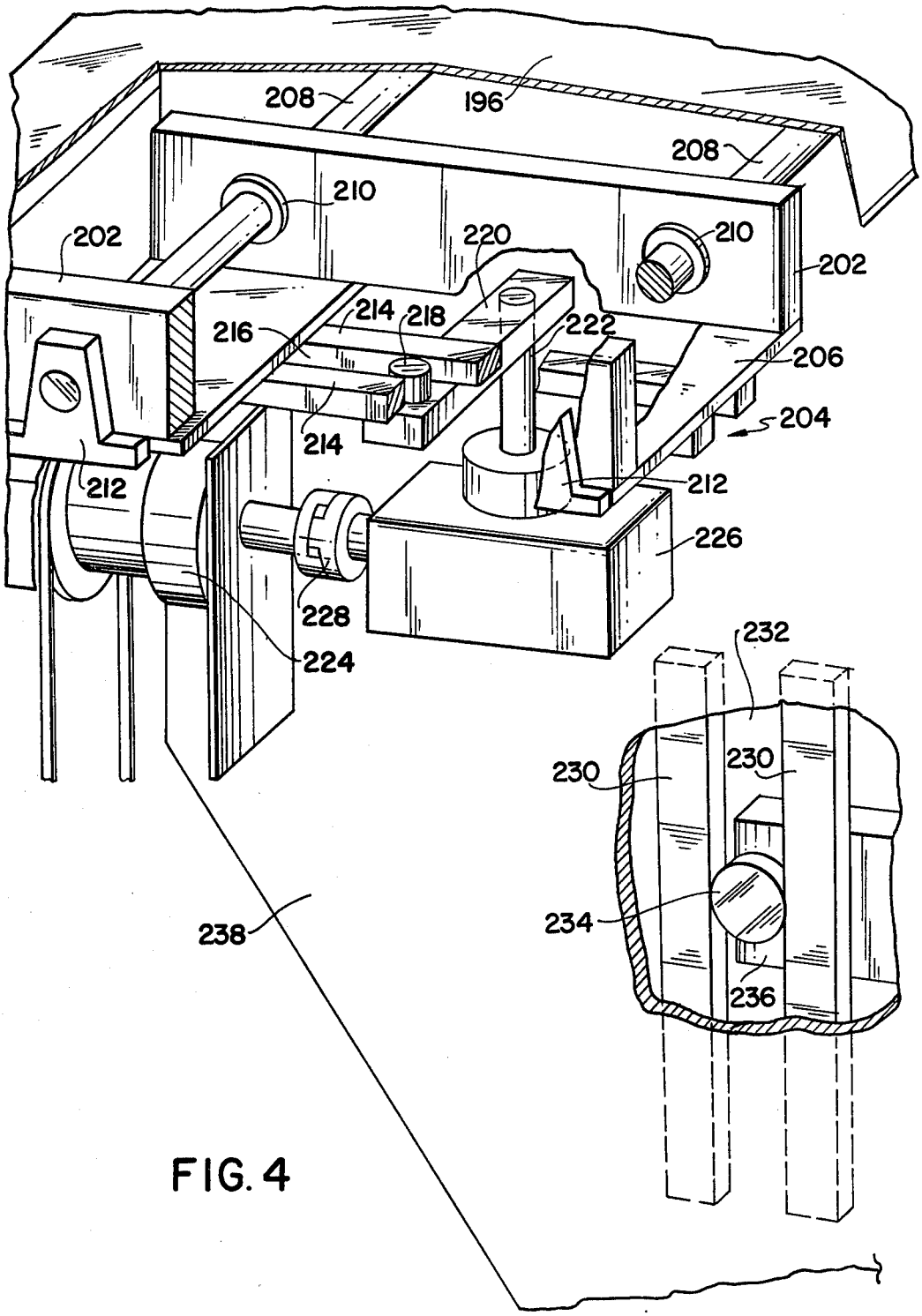
FIG. 4 is a perspective view of an assembly for causing reciprocal movement of the ejection blade and for translating the shuttle box between the first and second locations.

As shown in FIG. 1, the ejecting assembly 106 is constructed from a horizontally positioned generally rectangular ejector blade 196. The ejector blade 196 is adjustably secured, by a plurality of bolts 198 extending through a respective slot 200 provided in the ejector blade, to a pair of parallel spaced support members 202 underlying the ejector blade as best illustrated in FIG. 4. Specifically referring to FIG. 4, the ejector blade 196 is adapted for reciprocal movement in a generally horizontal plane by operation of a reciprocating assembly 204. The reciprocating assembly 204 is generally constructed from the pair of spaced apart support members 202 supported by a bottom wall 206 slidably mounted to a pair of longitudinally extending parallel spaced rods 208 by a plurality of bearings 210. The terminal ends of the rods 208 are secured within a respective block 212. A pair of parallel spaced bars 214 are secured to the underside of the bottom wall 206 to provide a slot 216 therebetween adapted to receive a cam follower 218. The cam follower 218 is secured to one end of a rotary arm 220 having its other end secured to a shaft 222 coupled to a single revolution clutch 224 by a gear box 226 and coupling 228.

The single revolution clutch 224 is of the type known to those skilled in the art and the reciprocating assembly 204 is operative to reciprocate the ejector blade 196 in a known manner. Briefly, the engagement of the single revolution clutch 224 causes the rotary arm 220 to revolve one revolution about the shaft 222. In this manner, the engagement of the cam follower 218 within the slot 216 provided between the bars 214 causes the ejector blade 196 to reciprocate once in a generally horizontal direction to and from the shuttle box 146.

In a similar arrangement, the translating assembly 110 is generally constructed from a pair of parallel spaced bars 230 defining a slot 232 therebetween and adapted to receive a cam follower 234 secured to one end of a rotary arm 236. The translating assembly 110 is attached to the rear surface of a vertically oriented supporting wall 238. The supporting wall 238, as shown in FIG. 3, has attached a pair of spaced apart tabs 239 through which rod 180 extends and between which the frame members 177 are disposed. The operation of the translating assembly 110 is precisely the same as that with respect to the operation of the reciprocating assembly 204. In this regard, rotation of the rotary arm 236 is effective to cause translating movement of the shuttle box 146 along rods 180, 192 by its having the side frames 177 disposed between the tabs 239 of the supporting wall 238 so as to translate the shuttle box to and from a location in alignment with the loading assembly 102.

As shown in FIG. 1, the rotating assembly 108 is constructed from a rotary arm 240 having one end secured to a shaft 242 and its other end coupled to one end of the support block 188 by a linking member 244. The rotary arm 240 is operative by assembly 178 to rotate the loading assembly 102 and receiving assembly 104, i.e., the pusher bar 116 and shuttle box 146, from a vertical to horizontal orientation or horizontal to vertical orientation.

The operation of the apparatus 100 as shown in FIG. 1, is accomplished by the operating assembly 112. The operating assembly 112 is generally constructed from a motor 246 connected to a main drive shaft 248 by a coupling 250. The rotating assembly 108 is connected to the main drive shaft 248 by a pair of sprocket assemblies **252*a*, 252*b* connected to a single revolution clutch 254. The sprocket assembly 252*b* is connected to the shaft 242 and has its sprockets sized to cause a one-half revolution of the rotary arm 240 upon a full revolution of the single revolution clutch 254. In this manner, the rotating assembly 108 can be operative to rotate the pusher bar 116 and shuttle box 146 from a vertical to a horizontal orientation and then back at a later time to a vertical orientation. In a similar arrangement, the translating assembly 110 is coupled to the main drive shaft 248 by a pair of sprocket assemblies 256*a*, 256*b* coupled together by a single revolution clutch 258. The sprocket assembly 256*b* as coupled to rotary arm 236 of the translating assembly 110 has its sprockets sized such that one revolution of the single revolution clutch 258 is operative to translate the shuttle box 146 from its position as illustrated in FIG. 1 to a position in alignment with the pusher bar 116 of the loading assembly 102. A second revolution of the single revolution clutch 258 is therefore operative to translate the shuttle box 146 from a position aligned with the pusher bar 116 to its original position as illustrated in FIG. 1. As previously described, the reciprocating assembly 204 has been described with reference to FIG. 4. In this regard, the reciprocating assembly 204 is operatively coupled to the main drive shaft 248 by the single revolution clutch 224 and a pair of sprocket assemblies 206*a*, 206*b* as illustrated in FIG. 1**.

Figure 6:
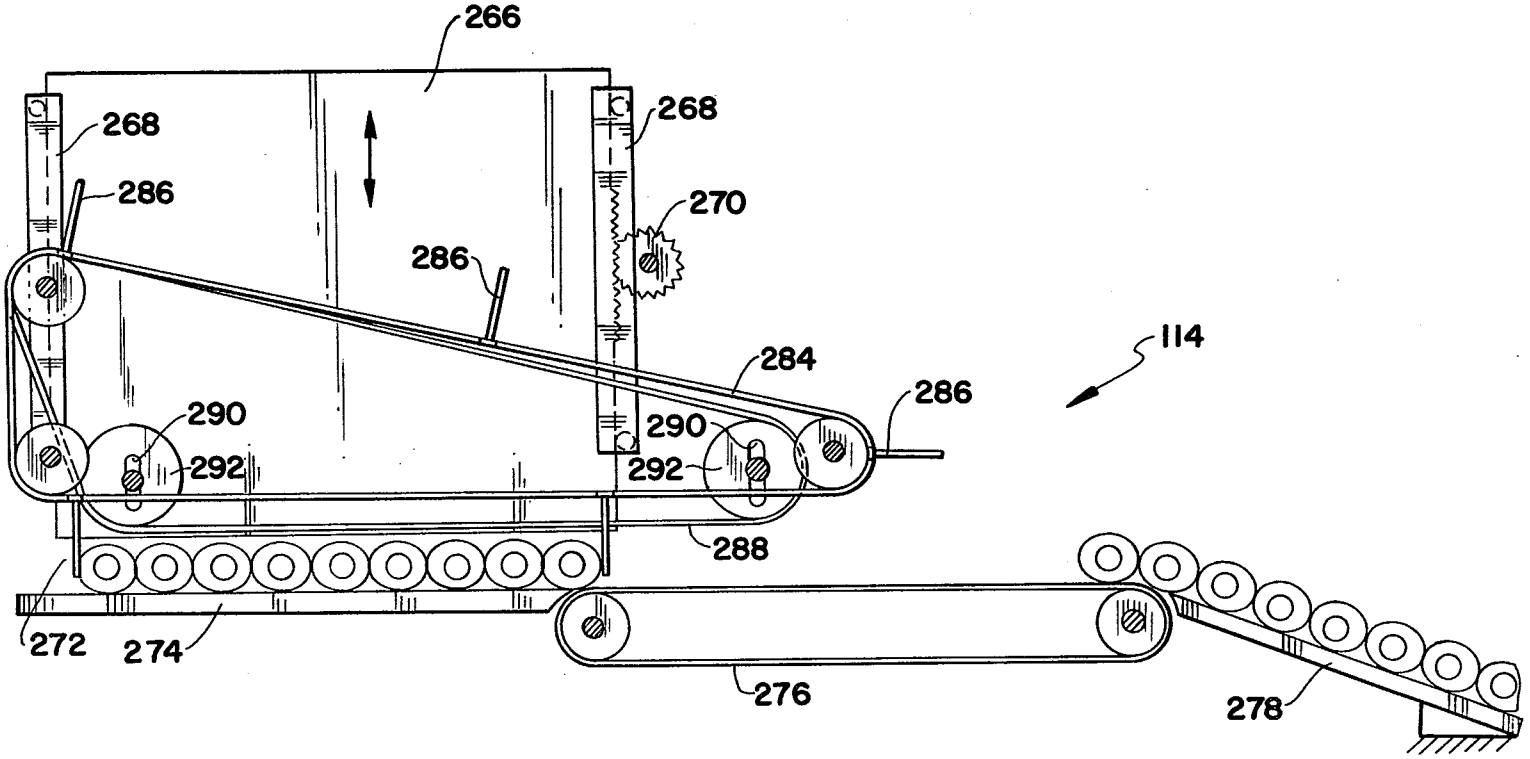
FIG. 6 is a rear elevation of the apparatus illustrated in FIG. 1 showing the construction of a cleated conveyor for transporting groups of articles away from the apparatus in aligned relationship.

The apparatus 100 of the present invention is further provided with a conveyor 262 adapted for conveying shipping cartons containing a plurality of articles therein from a supply source thereof to a stop plate 264 located at the end of the conveyor in alignment with one side edge of the pusher bar 116. Proximate to the stop plate 264, there is provided a retaining wall 266 as best illustrated in FIG. 6. The retaining wall 266 is adjustably positioned to be in operative association with shuttle box 146 in a manner to substantially close the opening 148 of the shuttle box when the shuttle box is in its position as illustrated in FIG. 1. The retaining wall 266 is adjustably secured to the apparatus 100 between a pair of guides 268 having an adjustment device 270 adapted to cause fixed movement of the retaining wall a predetermined distance in a generally vertical direction. In this manner, an opening 272 of a predetermined size may be provided along the bottom edge of the shuttle box 146 adjacent the bottom wall 168, as to be described hereinafter.

The construction of the apparatus 100 of the present invention has now been described in detail except for the conveying assembly 114, which assembly will be described in detail hereinafter. In this regard, the operation of the apparatus 100 in accordance with the method of the present invention will now be described with general reference to the timing diagram of FIG. 9 and the diagramatical views of FIG. 10–16 and, more specifically, with reference to the apparatus as illustrated in FIGS. 1–8. In accordance with one aspect of the present invention, the operation of the apparatus 100 will be described for supplying collapsable tubes, e.g., toothpaste, paint or medicine, from a cardboard shipping carton. As noted above, the apparatus 100 of the present invention may be used for suppyling articles other than those specifically mentioned therein. In this regard, a shipping carton having a plurality of tubes arranged in an array of generally defined rows and columns is supplied to the apparatus 100 by conveyor 262. The shipping carton initially has its top flaps or cover removed when so provided and is positioned on the conveyor 262 on its side having its closed bottom facing the pusher bar 116. It is not a requirement of the present invention that the shipping cartons be provided singularly to the conveyor 262, as a continuous stream of such shipping cartons may be supplied to the apparatus along the conveyor 262.

Figures 10, 11, 12:
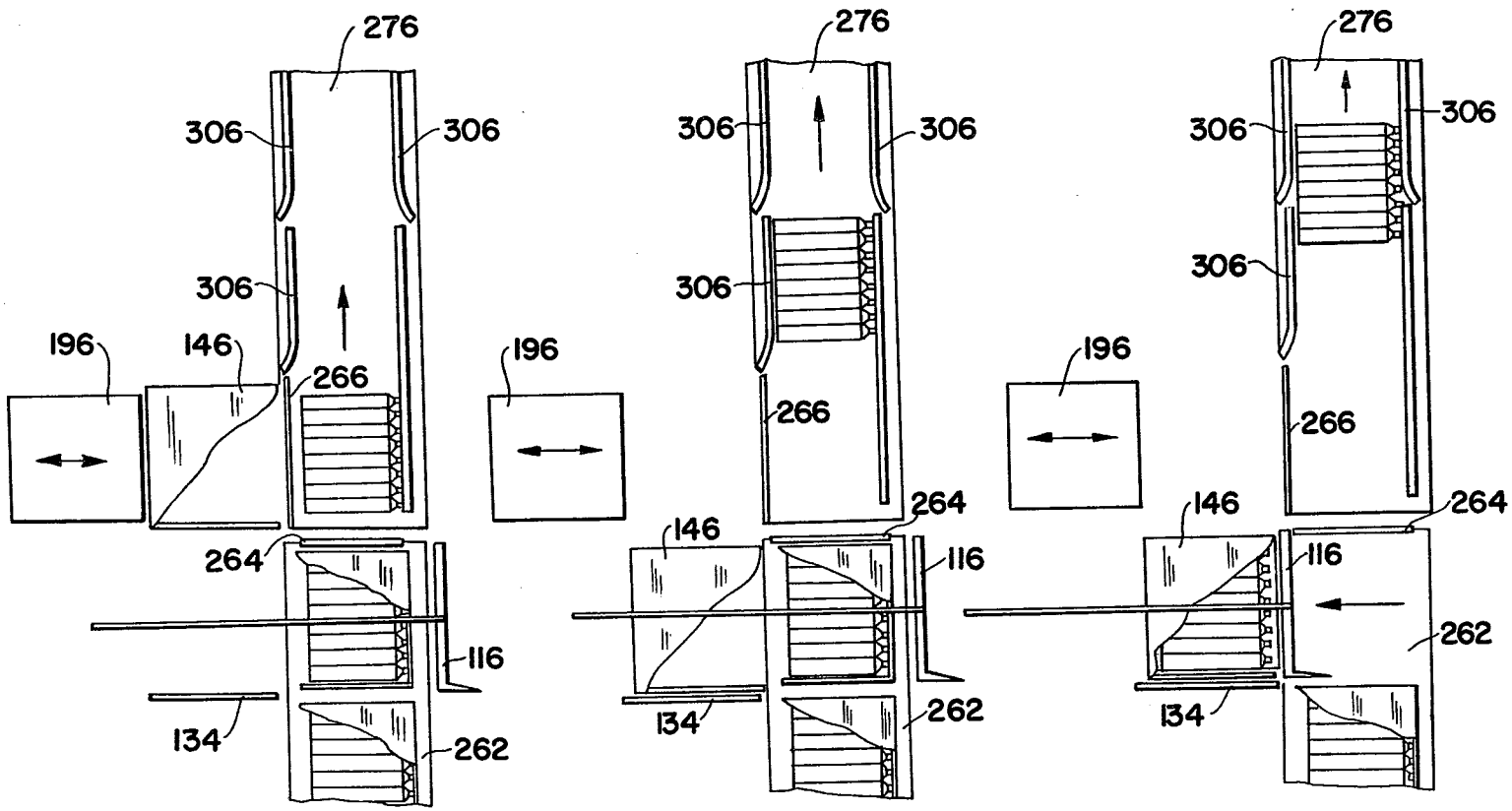
Figure 16:
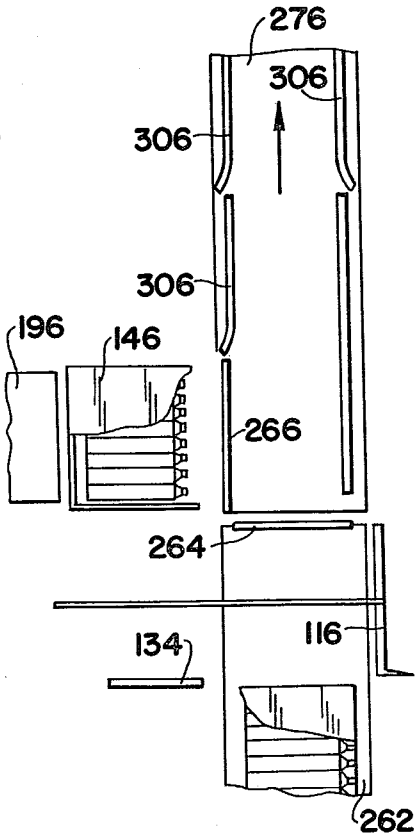

The shipping carton is brought by the conveyor 262 into a position abutting the stop plate 264 and having its bottom wall in alignment with the pusher bar 116 (see FIG. 10). The single revolution clutch 258 is activated to cause the translating assembly 110 to slide the shuttle box 146 along rods 180, 192 to a position underlying the top frame member 140 of the support member 134 where its open side 148 is in general alignment with the carton and pusher bar 116 (see FIG. 11). The hydraulic cylinder 142 causes the pusher bar 116 to slide the carton off the conveyor 262 and into the shuttle box 146 through the open side 148. As the pusher bar 116 slides the carton along the conveyor 262, the separating plate 118 is effective to separate such carton from an adjacent carton provided on the conveyor when a continuous stream of such cartons are being supplied to the apparatus 100 (see FIG. 12). However, when a carton is brought by the conveyor 262 into a position abutting the stop plate 264, the conveyor may be stopped and restarted after the push bar 116 is returned to the position as shown in FIG. 1. The loading of the carton into the shuttle box 146 has occurred while the shuttle box has been oriented in a substantially vertical orientation at a first location in alignment with the pusher bar 116.

Once the carton has been loaded into the shuttle box 146, activation of the single revolution clutch 254 causes the rotating assembly 108 to rotate the assembly 178 in a counterclockwise direction from its position illustrated in FIG. 1. In this regard, both the shuttle box 146 and loading assembly 102, including the pusher bar 116, have been rotated into a substantially horizontal orientation from their vertical orientation such that the open side 148 of the shuttle box is facing upward (see FIG. 13). However, it is contemplated that in accordance with the present invention, the shuttle box can be positioned in other than a substantially horizontal and vertical orientation to effect operation of the apparatus 100. In this regard, it is also contemplated that the conveyor 262 and/or slide table 274 may be provided at an inclined orientation. During rotation of the shuttle box 146 and pusher bar 116, the pusher bar has been maintained in contact with the bottom of the carton throughout such rotation. The vacuum grippers 130 on the pusher bar 116 are operable to grasp the bottom of the carton and to secure such carton to the pusher bar. As such, operation of the hydraulic cylinder 142 causes the pusher bar 116 to be moved upward away from the open side 148 of the shuttle bar 146. The carton, being secured to the pusher bar 116 by the vacuum grippers 130, is effectively withdrawn from the shuttle box 146 leaving the plurality of tubes remaining within the confines of the shuttle box (see FIG. 14).

Figure 8:
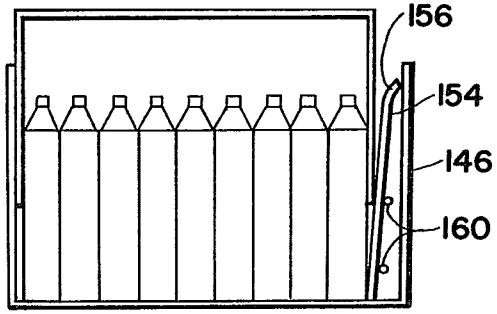
FIG. 8 is a top view of the shuttle box having a plurality of aligned articles retained in such alignment by a spring biased retaining wall and further showing the storage carton partially removed therefrom.

In accordance with the method of the present invention, it is not required that the tubes provided within the shipping carton be separated from a neighboring tube by a cardboard insert. However, it is desirable to maintain such tubes in layers in the shuttle box 146 upon removal of the shipping carton from the shuttle box. In this regard, it has been found that depending upon the specific arrangement of the tubes within the shipping carton, it has been possible for one tube from one layer to displace itself into a portion of a lower layer upon removal of the carton from the shuttle box 146. To overcome such condition, the spring biased retaining wall 154, as illustrated in FIG. 2, has been provided within the shuttle box 146. The curved end 156 of the retaining wall 154 facilitates the alignment and initial loading of the carton into the shuttle box 146. As the carton is loaded into the shuttle box 146, the bias springs 170 are operative to press the retaining wall 154 gently against the side of the carton. In this regard, as the carton is withdrawn from the shuttle box 146, the innermost end of the retaining wall 154 is drawn inwardly by operation of the bias springs 170 to accomodate the void created by the thickness of the sidewalls of the carton. As illustrated in FIG. 8, as the carton is withdrawn from the shuttle box 146, the retaining wall 154 engages a portion of the tubes so as to maintain their relative aligned and layered arrangement as originally provided within the carton. In this manner, the carton may be withdrawn from the shuttle box 146 without disturbing the layered array of tubes provided in the carton by the retaining wall 154 accomodating for the void created by the removal of the sidewalls of the carton to prevent spreading of the tubes such that one of them may be disposed partially into a lower layer.

Figure 15:
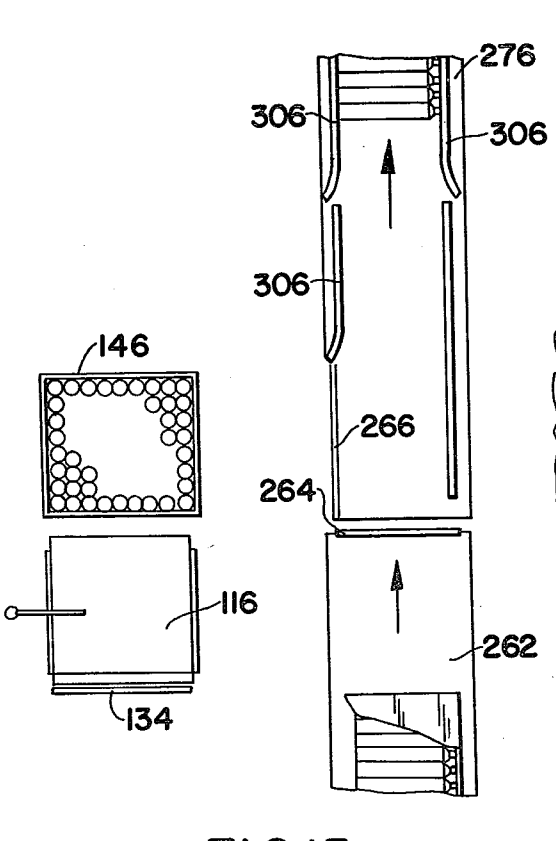
Figure 13:
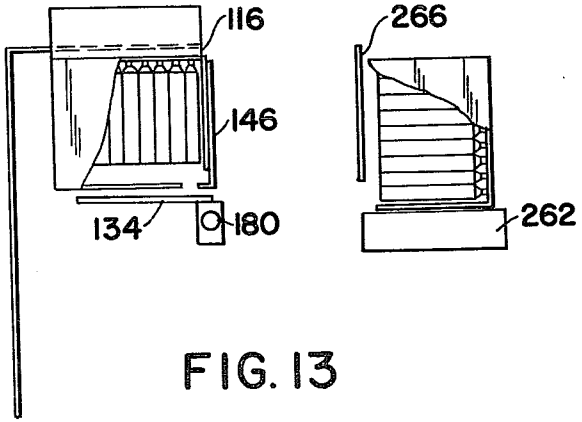
Figure 14:
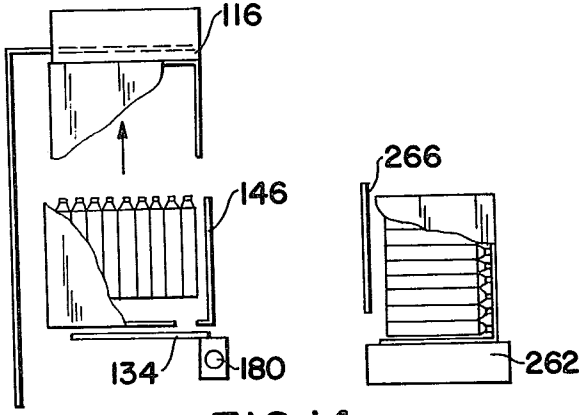

With the carton having been withdrawn from the shuttle box 146 by the pusher bar 116, the single revolution clutch 258 is activated to cause the translating assembly 110 to translate the shuttle box and contained articles from adjacent the support member 134 to its initial location in alignment with the ejecting assembly 106 while the shuttle box remains in a substantially horizontal orientation (see FIG. 15). During such operation, the vacuum supply may be terminated from the vacuum grippers 130 to allow removal of the carton from the pusher bar 116, for example, by dropping therefrom. Activation of the single revolution clutch 254 causes rotation of the assembly 178 to its original orientation such that the pusher bar 116 and shuttle box 146 are rotated from their horizontal orientation and returned to their original substantially vertical orientation (see FIG. 16). As the shuttle box 146 is rotated from its horizontal to vertical orientation, the open side 148 of the shuttle box increasingly communicates with the retaining wall 266 to prevent the inadvertent falling outward of the tubes through the open side of the shuttle box. With the shuttle box 146 in its substantially vertical orientation as shown in FIG. 1, the retaining wall 266 provides a substantial closure for the open side 148 except for the opening 272 as previously described.

The tubes, as originally arranged in the shipping carton, have now been transferred to the shuttle box 146 in a position in alignment with the ejecting assembly 106. The forward end of the ejector blade 196 of the ejecting assembly 106 is arranged in alignment with the slot 152 provided in the rear wall 150 of the shuttle box 146. Activation of the single revolution clutch 224 causes reciprocal movement of the ejector blade 196 into the shuttle box 146 through the slot 152. As the forward end of the ejector blade 196 enters the slot 152, such end engages the lowermost layer of tubes causing such tubes to be pushed out from the shuttle box through the opening 272 provided by the association of the retaining wall 266 with the open side 148 of the shuttle box. As each layer of tubes are ejected from the shuttle box 146, the next adjacent layer of such tubes moves downward within the shuttle box to a lowermost position so as to be engaged by the ejector blade 196 during its second reciprocating cycle through slot 152. In this manner, the articles provided within the shuttle box 146 can be removed row-by-row, accurately, cheaply, continuously and rapidly, and adapted for use with high speed automatic processing machines. Once the articles have been removed from the shuttle box 146, the method of the present invention, as thus described, is repeated.

The apparatus 100 of the present invention is adapted to accomodate various size shipping cartons and various sized and shaped articles arranged therein. In this regard, a number of shuttle boxes 146 of different size can be provided for accomodating a shipping carton of compatible dimension. In addition, the ejector blade 196 may be replaced by an ejector blade of shorter or longer length to accomodate articles of corresponding shorter or longer dimension. In addition, the opening 272 provided by retaining wall 266 can be suitably adjusted to allow for the passage of articles of varying diameter. Accordingly, it can be appreciated that the apparatus and method of the present invention have been adapted to be versatile in the ability to supply various sized and shaped articles from a shipping carton to a machine for further processing. In this regard, the apparatus of the present invention is generally adapted for supplying plural articles provided in an array within a carton. The apparatus is generally constructed from a shuttle box for receiving a carton having a plurality of articles arranged in an array therein, means for translating the receiving means between a shuttle box loading location and a shuttle box removing location, means for rotating the shuttle box into a substantially vertical and horizontal orientation at the shuttle box loading and article removing locations, a pusher bar located at the shuttle box loading location for pushing the carton into the shuttle box when the shuttle box is arranged thereat in the vertical orientation, a carton grasping device provided in association with the pusher bar for gripping a portion of the carton for removing the carton from the shuttle box when the shuttle box is arranged at the shuttle box loading location in the horizontal orientation such that the plurality of articles remain within the shuttle box in the array, and an ejector blade adapted for reciprocal movement between a first and second position at the article removing location, the ejector blade removing a portion of the array of the articles from the shuttle box upon movement of the ejector blade from the first position to the second position when the shuttle box is arranged at the article removing location in the vertical orientation.

Once the articles have been removed from the shuttle box 146, it is required that such articles be conveyed to the machine for further processing. In this regard, it has been found that due to the nonuniform cross-sectional shape of certain articles, e.g., toothpaste tubes, such articles when being conveyed have a tendency to twist and turn out of alignment such that they are received by the further processing machine in an improper orientation. It is therefore considered desirable to be able to supply such articles to a machine for further processing in aligned groups whereby they maintain their proper orientation from the unloading of the shuttle box 146 through their conveying to the machine. One embodiment for accomplishing the conveying of such articles in aligned groups is disclosed in FIG. 1. The conveying assembly 114 is constructed from a slide table 274 positioned adjacent the opening 272 through which the articles are ejected from the shuttle box 146. Adjacent the slide table 274 is a conveyor 276 for conveying such articles to a ramp 278 which can be made to fit directly into a hopper or other infeed device for a machine for further processing of such articles. To maintain such articles in aligned groups, a cleated conveyor 280 having a plurality of cleats 282 extending transverse thereto is provided overlying the slide table 274 and a portion of the conveyor 278. Briefly, in operation of such conveying assembly 114, a pair of adjacent cleats 282 are spaced to receive one row of articles therebetween. In this regard, such adjacent cleats 282 confine the articles as they are transported by the cleated conveyor 280 along the slide table 274 and onto the conveyor 278 such that the articles maintain their aligned relationship by their confinement between adjacent cleats.

Figure 7:
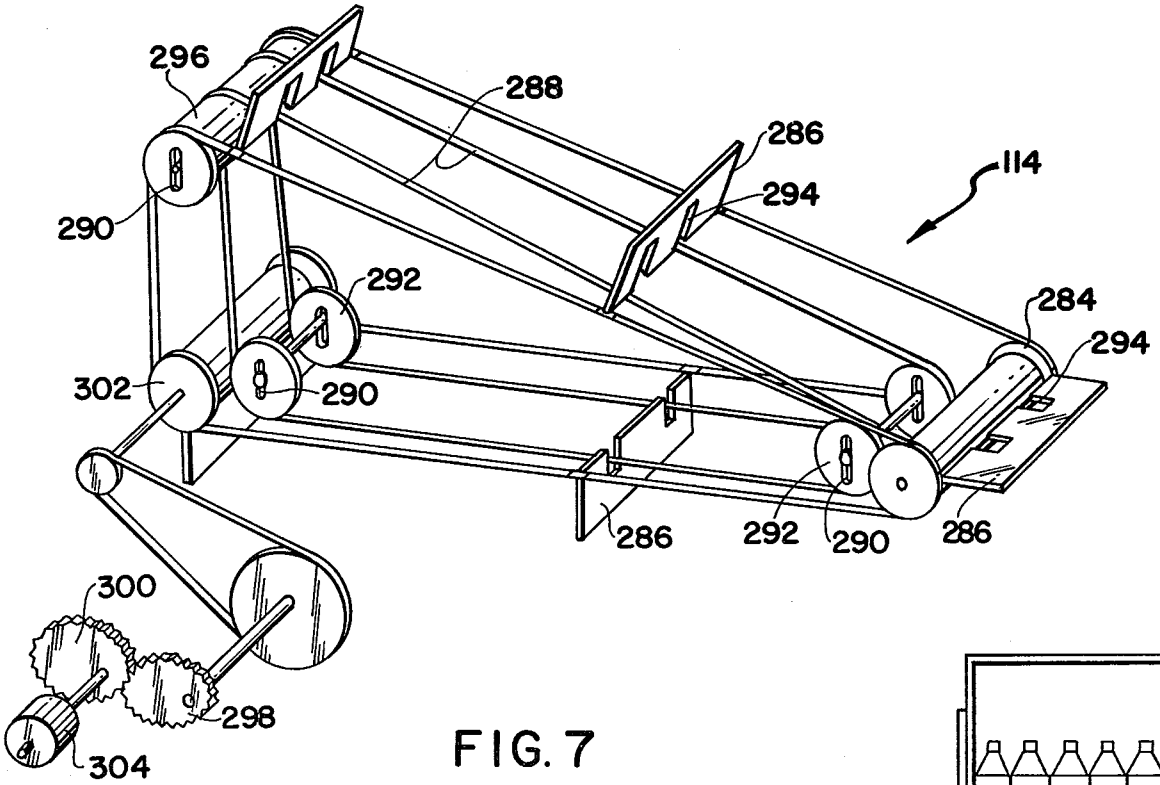
FIG. 7 is a perspective view of the construction of the conveyor as illustrated in FIG. 6.
Figure 9:
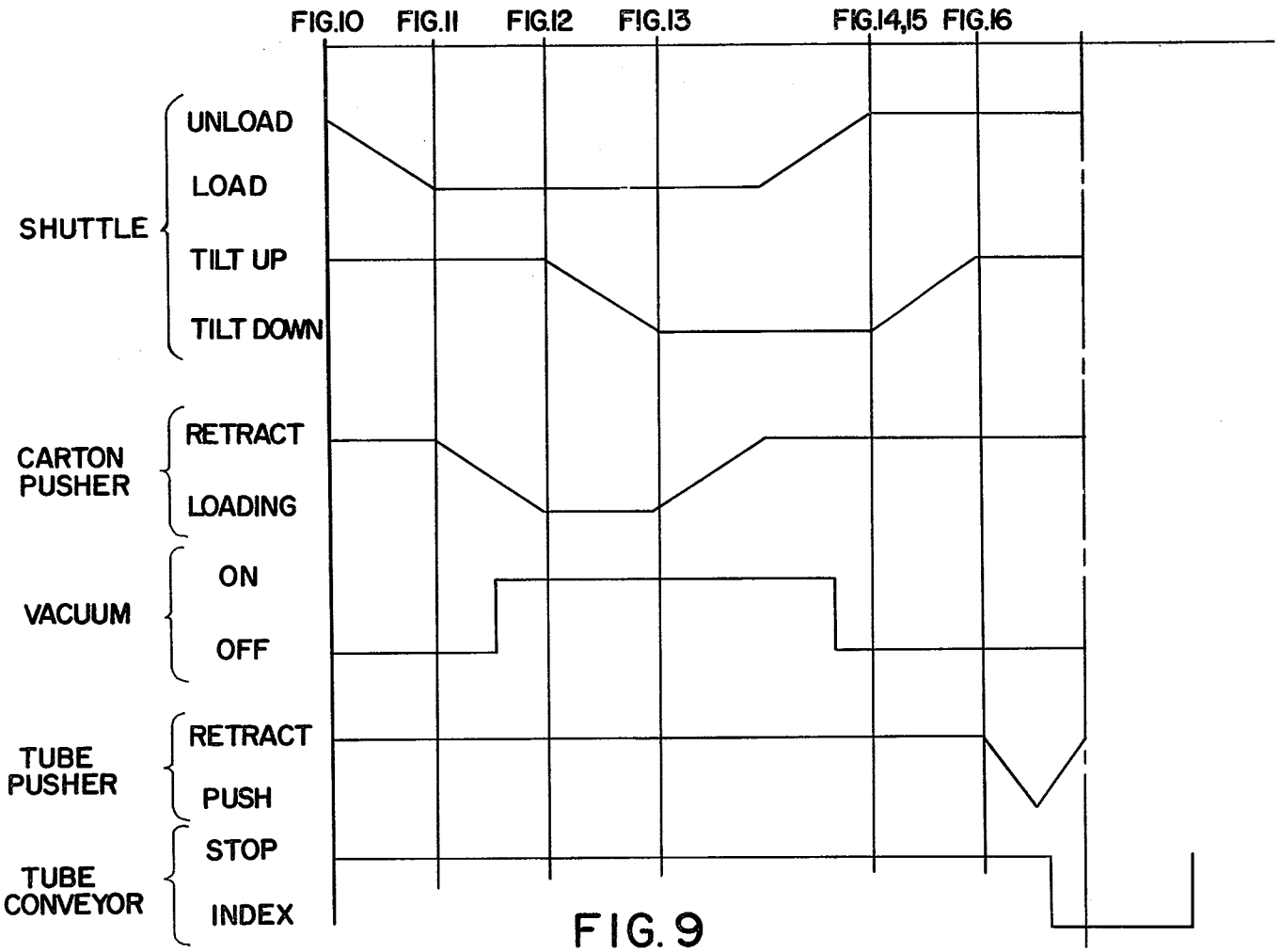
FIG. 9 is a timing diagram illustrating the sequence of operation of the apparatus and method of the present invention; and, FIGS. 10–16 are various diagramatical views which illustrate the method of the present invention of supplying plural articles provided in array in a shipping carton and referred to in FIG. 9.

There is further shown in FIGS. 6 and 7 an additional embodiment of the conveying assembly 114. In this regard, there is provided a slide table 274, a conveyor 276 and a ramp 278 as previously described. Overlying the slide table 274 and a portion of the conveyor 276, there is provided a cleated conveyor 284 having a plurality of cleats 286 extending therefrom which operate in the same manner as previously described with respect to the cleated conveyor 280 as illustrated in FIG. 1. In addition to the cleated conveyor 284 as shown in FIG. 6, there is provided a second conveyor 288 positioned within the cleated conveyor as best illustrated in FIG. 7. The conveyor 288 is adapted to closely overlie the top surface of the article as arranged in groups between adjacent pair of cleats 286 of the cleated conveyor 284. In this manner, such articles are prevented from bobbing up and down and are assisted in their being transported along the slide table 274 and onto the conveyor 276. As illustrated in FIG. 7, the conveyor 288 is made adjustable for articles of varying diameter by the slots 290 provided for lowering and raising the rollers 292 accordingly. The ability to lower or raise the conveyor 288 without interference with the cleats 286 on the cleated conveyor 284 is accomplished by the slots 294 provided within such cleats. The conveyor 288 is driven in synchronization with the cleated conveyor 282 by their common engagement with roller 296, which roller is also adjustable by a slot 290.

The operation of the conveying assembly 114 in accordance with the embodiment illustrated in FIG. 7 will now be briefly described. In this regard, a pair of elliptical gears 298, 300 are provided for driving roller 302 upon operation of a single revolution clutch 304. The elliptical gears allow the articles to be slid from the slide table 274 at a linear rate faster than that of the conveyor 276, while being able to deposit such articles on the conveyor 276 at the matched speed of such conveyor. Specifically, one revolution of the single revolution clutch 304 cuases the elliptical gears to operate through one revolution such that one group of articles provided between adjacent cleats are slid from the slide table 274 and onto the conveyor 276. During the single revolution of the elliptical gears, the cleated conveyor 284 is initially operated at a linear speed about equal to that of the conveyor 276 and then at an increasing rate, and subsequently at a decreasing rate to its initial linear speed. As the cleated conveyor 284 positions such articles on the conveyor 276, the speed of the cleated conveyor is reduced to match that of the conveyor 276. The removing of articles from the slide table 274 at an average rate faster than the articles are being transported by the conveyor 276 allows for the accumulation of such articles on the conveyor 276 or ramp 278, thereby providing a continuous accumulated supply of such articles to the machine for further processing. In this regard, such arrangement and operation of the conveying assembly 114 using pairs of elliptical gears is adaptable for use with high speed processing machines. Once the articles have been positioned on the conveyor 276, such articles may be retained between guide rails 306 having flared receiving ends.

Although the invention herein has been described with reference to particular embodiments, it is to be understood that these embodiments are merely illustrative of the principles and application of the present invention. For example, it is contemplated that the articles may be removed from the shuttle box, column-by-column, by vertically orienting the ejector blade as opposed to row-by-row. In addtion, the tubes can be conveyed away from the shuttle box in a direction parallel to the travelling direction of the ejector blade. It is therefore to be understood that numerous modifications may be made in the illustrative embodiments and that other arrangements may be devised without departing from the spirit and scope of the present invention as defined by the appended claims.

What is claimed is:

1. An apparatus for supplying articles provided in a carton, said apparatus comprising means for receiving a carton having a plurality of articles provided therein and for containing said articles upon withdrawl of said carton, means for arranging said receiving means in a first and second orientation, means for translating said receiving means between a first and second location, means for placing said carton into said receiving means when said receiving means is arranged in said first orientation at said first location, means for withdrawing said carton from said receiving means when said receiving means is arranged in said second orientation wherein said plurality of said articles remain within said receiving means, and means for removing said plurality of articles from said receiving means when said receiving means is arranged at said second location.

2. The apparatus as set forth in claim 1 wherein said arranging means is operable to rotate said receiving means between said first and second orientations at said first and second locations.

3. The apparatus as set forth in claim 1 further including means for transporting said articles in groups of aligned articles away from said apparatus upon removal of said articles from said receiving means.

4. The apparatus as set forth in claim 3 wherein said receiving means further includes means for retaining said articles arranged in said groups within said receiving means upon withdrawal of said carton therefrom.

5. The Apparatus as set forth in claim 1 wherein said arranging of said receiving means in a first orientation comprises a substantially vertical orientation and said second orientation comprises a substantially horizontal orientation.

6. The apparatus as set forth in claim 1 wherein said placing means and said withdrawing means are provided at said first location, and said removing means is provided at said second location.

7. An apparatus for supplying articles provided in a carton, said apparatus comprising means for receiving a carton, having a plurality of articles arranged in an array, means for translating said receiving means between a first and second location, means for positioning said receiving means in a substantially vertical and horizontal orientation at said first and second locations, means at said first location for placing said carton into said receiving means when said receiving means is arranged thereat in a vertical orientation, means for withdrawing said carton from said receiving means when said receiving means is arranged in a horizontal orientation wherein said plurality of articles remain within said receiving means, and means at said second location for removing said plurality of articles from said receiving means.

8. The apparatus as set forth in claim 7 wherein said withdrawing means are operative to withdraw said carton from said receiving means when said receiving means is arranged in said horizontal orientation at said first location.

9. The apparatus as set forth in claim 7 wherein said receiving means is constructed of a shuttle box having an opening adapted to receive said carton and having a rear wall opposite said opening provided with a slot arranged to reciprocally receive a portion of said removing means.

10. The apparatus as set forth in claim 9 wherein said shuttle box further includes a spring biased retaining wall for retaining said articles in said array within said shuttle box upon withdrawal of said carton therefrom.

11. The apparatus as set forth in claim 9 wherein said removing means is constructed of an ejection blade adapted for recriprocal movement into said slot in the rear wall of said shuttle box for removing a portion of said array of said articles from said shuttle box by engagement of the leading edge of said ejection blade with said portion of said array of said articles upon entering said shuttle box through said slot.

12. The apparatus as set forth in claim 7 further including a motor adapted for operation of said translating means, said positioning means, said withdrawing means and said removing means in timed relationship.

13. An apparatus for supplying plural articles provided in an array within a carton, said apparatus comprising a shuttle box for receiving a carton having a plurality of articles arranged in an array therein, means for translating said shuttle box between a shuttle box loading location and an article removing location, means for rotating said shuttle box into a substantially vertical and horizontal orientation at said shuttle box loading and article removing locations, a pusher bar located at said shuttle box loading location for pushing said carton into said shuttle box when said shuttle box is arranged thereat in said vertical orientation, a carton grasping device provided in association with said pusher bar for gripping a portion of said carton for removing said carton from said shuttle box when said shuttle box is arranged at said shuttle box loading location in said horizontal orientation such that said plurality of articles remain within said shuttle box in said array, and an ejector blade adapted for reciprocal movement between a first and second position at said article removing location, said ejector blade removing a portion of said array of said articles from said shuttle box upon movement of said ejector blade from said first position to said second position when said shuttle box is arranged at said article removing location in said vertical orientation.

14. The apparatus as set forth in claim 13 wherein said shuttle box includes a rear wall having a slot therein adapted to receive said ejector blade upon reciprocal movement of said ejector blade between said first and second positions.

15. The apparatus as set forth in claim 13 wherein said rotating means is adapted for rotating said carton gripping device between said vertical and horizontal orientation at said shuttle box loading location.

16. A method for supplying articles provided in a carton, said method comprising the steps of providing a receptacle constructed and arranged for receiving a carton having a plurality of articles provided therein and for containing said articles upon withdrawl of said carton, said receptacle adapted to be arranged in a first and second orientation, placing said carton into said receptacle when said receptacle is arranged in said first orientation, withdrawing said carton from said receptacle when said receptacle is arranged in said second orientation wherein said plurality of said articles remain within said receptacle, removing said plurality of articles from said receptacle, and translating said receptacle between a first location for said placing of said carton therein and a second location for said removing of said plurality of articles from said receptacle.

17. The method as set forth in claim 16 further including the step of transporting said plurality of articles in groups away from said receptacle upon removal of said articles therefrom.

18. A method for supplying articles provided in a carton, said method comprising the steps of providing a receptacle constructed and arranged for receiving a carton and having a plurality of articles arranged in an array provided therein, positioning said receptacle in a substantially vertical orientation at a first location, placing said carton into said receptacle, positioning said receptacle having said carton therein in a substantially horizontal orientation at said first location, withdrawing said carton from said receptacle wherein said plurality of articles remain within said receptacle, translating said receptacle from said first location to a second location, positioning said receptacle having said plurality of articles retained therein in a substantially vertical orientation, and removing said plurality of articles from said receptacle at said second location.

19. The method as set forth in claim 18 further including the step of providing to said receptacle a supply of cartons having said plurality of articles arranged in an array provided therein.

20. A method for supplying articles provided in an array within a carton, said method comprising the steps of providing a shuttle box for receiving a carton having a plurality of articles in an array therein, said shuttle box adapted to be translated between a shuttle box loading location and an article removing location and adapted to be rotated into a substantially vertical and horizontal orientation at said shuttle box loading and article removing locations, pushing said carton into said shuttle box at said shuttle box loading location when said shuttle box is arranged thereat in said vertical orientation, gripping a portion of said carton within said shuttle box to remove said carton from said shuttle box when said shuttle box is arranged at said shuttle box loading location in said horizontal orientation wherein said plurality of articles remain within said shuttle box in said array, and removing a portion of said array of said articles from said shuttle box by the reciprocal movement of an ejector blade from a first position to a second position when said shuttle box is arranged at said article removing location in said vertical orientation.

21. The apparatus as set forth in claim 1 wherein said removing means removes less than the total number of said articles from said receiving means at one time.

22. The apparatus as set forth in claim 7 wherein said removing means removes less than the total number of said articles from said receiving means at one time.

23. The method as set forth in claim 16 wherein said removing of said articles from said receptacle comprises removing less than the total number of said articles from said receptacle at one time.

24. The method as set forth in claim 18 wherein said removing of said articles from said receptacle comprises removing less than the total number of said articles from said receptacle at one time.

* * * * *

UNITED STATES PATENT AND TRADEMARK OFFICE

CERTIFICATE OF CORRECTION

PATENT NO. : 4,482,282

DATED : November 13, 1984

INVENTOR(S) : Martin M. Wildmoser

It is certified that error appears in the above-identified patent and that said Letters Patent are hereby corrected as shown below:

In Column 8, line 36, change "206a, 206b" to read --260a, 260b--.

In Column 12, line 62, change "cuases" to --causes--.

Signed and Sealed this

*Fourteenth* Day of *May 1985*

[SEAL]

*Attest:*

DONALD J. QUIGG

*Attesting Officer* *Acting Commissioner of Patents and Trademarks*